US005151079A

United States Patent [19]

Flanigan et al.

[11] Patent Number: 5,151,079

[45] Date of Patent: Sep. 29, 1992

[54] METHOD AND APPARATUS FOR REDUCTION OF PARTICLE DISINTEGRATION

[75] Inventors: David A. Flanigan, Cleveland, Okla.; John D. Boadway, Kingston, Canada

[73] Assignee: Conoco Specialty Products Inc., Houston, Tex.

[21] Appl. No.: 589,720

[22] Filed: Sep. 27, 1990

[51] Int. Cl.[5] ..... B04B 11/00; B04B 1/20

[52] U.S. Cl. ..... 494/27; 494/31; 494/37; 494/53; 134/26

[58] Field of Search ..... 484/37, 53, 52, 54, 484/55, 56, 57, 45, 43, 31, 32, 27, 23, 28; 139/26

[56] References Cited

U.S. PATENT DOCUMENTS 2,176,982 10/1939 Thayer .
2,528,974 11/1950 Ritsch .
2,747,793 5/1956 Caddell .
3,221,985 12/1965 Burdett .
3,398,888 8/1968 Koenecke ..... 494/53
3,399,828 9/1968 Fassle ..... 494/53
4,298,162 11/1981 Hohne .
4,451,247 5/1984 Ostkamp et al. .
4,504,262 3/1985 Forsberg .
4,828,541 5/1989 Madsen .

*Primary Examiner*—Robert W. Jenkins
*Attorney, Agent, or Firm*—David W. Westphal

[57] ABSTRACT

This invention relates to an improved particulate receiving chamber within a centrifugal separation device and more particularly within a decanter centrifuge. The improved receiving chamber reduces particle disintegration of the particulates which is particularly advantageous if the particulates are subjected to a further centrifugal separation step because particle disintegration compromises the clarification achievable by successive centrifugal separators. The preferred embodiment of the particulate receiving chamber includes a plurality of spray nozzles for spraying fluid in the chamber whereby the fluid absorbs the impact forces of the particulates which impact against surfaces within the chamber.

31 Claims, 4 Drawing Sheets

METHOD AND APPARATUS FOR REDUCTION OF PARTICLE DISINTEGRATION

FIELD OF THE INVENTION

This invention relates to centrifugal separation devices and more particularly to decanter centrifuges for separating particulate solids from a liquid.

BACKGROUND OF THE INVENTION

Commonly owned U.S. Pat. application 07/487,350 filed Feb. 28, 1990, which is incorporated herein by reference, discloses the use of decanter centrifuges in a process for cleaning contaminated particulate solids. In particular, the above process is useful in offshore drilling operations where many tons of oil-laden particulate drill cuttings are generated by the drilling operation. In the process, the oil-laden particulate drill cuttings are mixed with a liquid solvent to dissolve the oil-based contaminant. The mixture of the particulate solids and contaminated solvent are then separated in a decanter centrifuge. The process further includes one or more repeated cycles of mixing with the solvent and separating the contaminated solvent in a decanter centrifuge. Once the particulate solids are fully cleaned they are discharged to the sea. As such, the cost of storing and transporting the solids ashore for processing and disposal are avoided.

As with all systems on an offshore platform, size and weight are important considerations and, accordingly, it is desirable to minimize the size and weight of the system while fulfilling the operational requirements. One of the important factors in reducing the size of the system is the clarification (the completeness of the liquid/solid separation) obtained by the decanter centrifuge. It is generally known that the clarification obtained by a decanter centrifuge is largely affected by the size thereof, or more precisely, the residence time of the mixture being separated in the decanter centrifuge (a larger centrifuge provides a greater residence time for the same flow rate). Thus, enhancing the clarification by other means may allow for a smaller centrifuge. Furthermore, better clarification by the decanter centrifuge reduces the demand on the related devices in the system and allows for a reduction in the size of the related devices or of the decanter centrifuge itself. Accordingly, any enhancement of the clarification of the decanter centrifuge would provide a valuable weight and size reduction for the cleaning system.

Through investigation of the clarification of decanter centrifuges it has been determined that clarification is also dependent upon the mean particle size of the particulate solids. In other words, the larger the mean particle size, the more complete the clarification (all other factors remaining the same). Accordingly, the investigation for enhancing clarification developed into an analysis of the process for identifying the steps in the cleaning process where particles are likely to be broken, shattered or otherwise reduced in size.

One place in the process identified as a potential reducer of particle size is at the outlet of the decanter centrifuge. Referring to FIGS. 1 and 2 of the drawings, the particles are discharged in a conventional decanter centrifuge from a rotating drum 30 into a particulate receiving chamber 22. Due to the high rotational speed of the drum, the solids are flung from the discharge ports 35 and slammed to the walls of the particulate receiving chamber 22. The impact forces of such a collision are likely to cause the particles to disintegrate into smaller particles. The particles may further stick to the wall and a particulate receiving surface, such as a metal bracket or plough shown as 39 in FIG. 2, then strikes the particles and drives them around to the exit chamber 22. This is a severe impact and may lead to substantial break up of particles.

The disintegration of the particles would not present a problem when the particles are fully cleaned, but in the process disclosed in the above patent application, particles separated by one decanter centrifuge are subsequently delivered to another decanter centrifuge. If the first centrifuge reduces the particle size, the second centrifuge will obtain a reduced clarification. Thus, the clarification of subsequent centrifuges is likely to be enhance by minimizing the particle disintegration at the discharge of the decanter centrifuge.

Accordingly, it is an object of the present invention to enhance the clarification obtained by centrifugal separation devices.

It is a more particular object of the present invention to reduce the size and weight of systems for cleaning particulate solids.

It is a further object of the present invention to reduce particle disintegration at the discharge of decanter centrifuges.

SUMMARY OF THE INVENTION

The above and other objects of the present invention are achieved by the provision of a centrifugal separation device comprising a particulate receiving surface, means for at least partially centrifugally separating the components of the mixture whereby the particulates are propelled against the surface and means for absorbing impact forces as the particulates impact against the surface.

The invention is further summarized as a method for reducing particle disintegration in a centrifugal separation device comprising the steps of whirling the mixture in a separation chamber to at least partially centrifugally separate the components and whereby the particulates are propelled against a particulate receiving surface with an impact force and absorbing the impact forces of the particulates impacting against the particulates receiving surface to reduce particle disintegration of the particulate solids.

One preferred arrangement of the invention is a system for washing particulate solids with liquid solvent to remove solvent soluble contaminant from the particulate solids. The system comprises a mixer for mixing contaminated particulate solids with liquid solvent to dissolve the contaminant from the solids and form a first mixture, a first separation chamber and means for introducing the first mixture to the first separation chamber. A first particulate receiving chamber is disposed to receive particulate solids from the first separation chamber, and the first separation chamber includes means for causing a whirling motion to the mixture therein to affect at least partial centrifugal separation of the liquid and particulate components thereof and whereby the particulate components of the mixture are propelled into the particulate receiving chamber and impact with an impact force against a surface therein. The invention further includes means for absorbing impact forces as the particulates impact against the surface in the particulate receiving chamber. A second mixer mixes particulate solids separated in said first separation chamber with liquid solvent to dissolve remaining contaminant on the particulate solids and form a second mixture which is to be introduced by introduction means to a second separation chamber. The invention further includes means in the second separation chamber for causing a whirling motion to the mixture therein to affect at least partial centrifugal separation of the liquid and particulate components thereof.

In a more particular preferred embodiment of the invention, the means for absorbing the impact forces comprises liquid solvent in the particulates receiving chamber and in the process of absorbing the impact forces the liquid solvent also mixes the particulates with the liquid solvent for the second stage of cleaning.

BRIEF DESCRIPTION OF THE DRAWINGS

Some of the objects of the invention have been stated and others will appear as the description proceeds when taken in connection with the accompanying drawings, in which.

DETAILED DESCRIPTION OF THE PREFERRED EMBODIMENT

Figure 1:
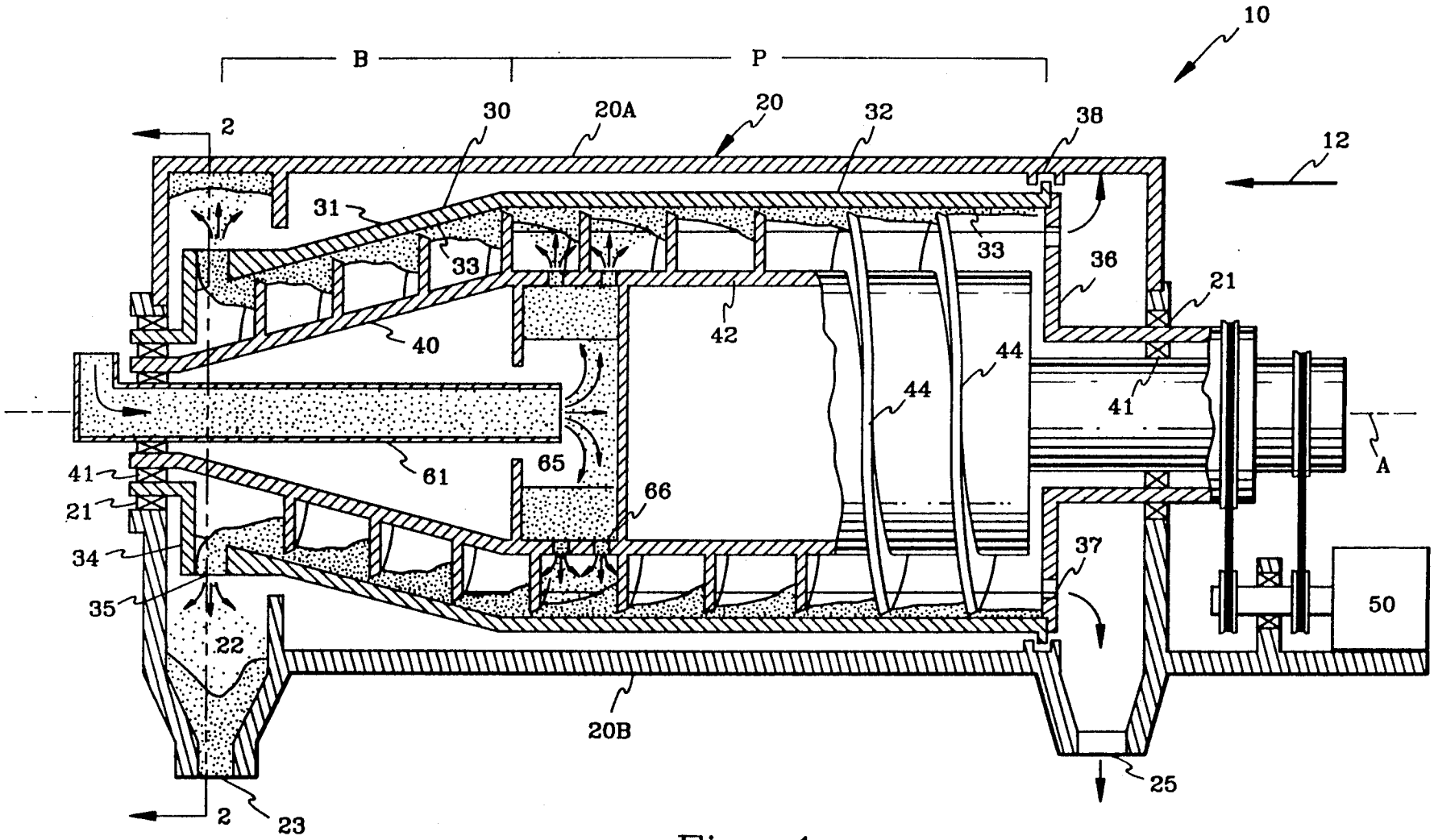
FIG. 1 is a partially fragmentary cross sectional view of a conventional decanter centrifuge.

As a brief explanation of the features and operation a decanter centrifuge, FIG. 1 illustrates a decanter centrifuge, generally indicated by the reference number 10, which is representative of the conventional design. However, it should be understood that conventional designs vary widely although the operation of each is generally similar. The decanter centrifuge 10 comprises an elongate casing 20 for housing a rotatable drum 30. The casing 20 comprises a base portion 20B which supports the internal mechanisms and a cover portion 20A which protects the operators from the machinery. The drum 30 is mounted within the casing 20 by suitable bearings 21 for rotation about an elongate axis A and is preferably formed of an elongate shell comprised of a frustoconical peripheral wall portion 31 and a cylindrical peripheral wall portion 32 coaxially extending from the large end of the frustoconical portion 31. A relatively smooth internal surface 33 extends around the inner circumference of the drum 30 along the length of the frustoconical and cylindrical portions 31 and 32. The drum 30 has a first end 34 at the small end of the frustoconical portion 31 which includes a number of ports 35 defining a solids outlet for discharging solids separated in the drum 30 into a particulate receiving chamber 22. The ports 35 are illustrated as extending radially through the shell of the frustoconical peripheral wall portion 31, however, the ports 35 may alternatively extend parallel to the axis A through the end 34 of the drum 30. Other suitable arrangements of the ports 35 may be designed to allow particulate solid material to exit the drum 30 adjacent the end 34 and be received by the casing 20.

The drum 30 further comprises a second end 36 at the opposite end of the drum 30 which includes Weirs 37. The weirs 37 may be adjustable to control the thickness of the fluid layer in drum 30. The weirs 37 discharge liquid into the space from the drum 30 between the end of the drum 30 and the casing with the baffle 38 retaining the liquid.

A helical conveyor 40 is disposed inside the drum 30 and mounted by suitable bearings 41 for rotation about the axis A. The conveyor 40 is supported by the bearings 41 at opposite ends thereof and comprises a cylindrical or generally cylindrical scroll tube 42 which is generally uniformly spaced from the internal surface 33 along the length of the drum 30. A helical blade 44 is attached to the outer surface of the scroll tube 42 and extends radially outwardly therefrom. The helical blade 44 is disposed at an angle with respect to the axis A so that rotation of the drum 30 relative to the helical conveyor 40 causes the blade 44 to displace and move any solid materials on the internal surface 33 toward one of the ends 34,36 of the drum 30.

A drive motor 50 is located at one end of the casing 20 for rotating the drum 30 and the conveyor 40 so that the conveyor 40 rotates slightly faster or slower than the drum 30. In the illustrated embodiment the conveyor 40 and the drum 30 rotate in a counter clockwise direction when viewed in the direction of arrow 12 and the conveyor 40 rotates faster than the drum 30. As such, the helical blade 40 moves any materials on the internal surface toward the solids outlet 35

In operation, the drive motor 50 spins the drum 30 and conveyor 40 about axis A at a high speed. The rotation of the drum 30 causes the particulates to whirl around the drum 30 and spread out on the internal surface 33 and centrifugally separate from the liquid solvent mixed therewith. The whirling motion causes the materials to centrifugally separate because of their different specific gravities and thus the heavier solids form a solids layer at the internal surface 33 and the lighter liquids form a liquid layer on the solids layer. At the same time the materials are centrifugally separating, the materials are being pushed along the internal surface 33 toward the solid outlet 35 at the first end 34 of the drum 30.

Along the internal surface 33, two distinct regions are created by the centrifugal forces of the rotating drum 30 and the pushing of the helical conveyor 40. The first region is called the pond and is indicated by the letter P. The pond P is the region where the solids and liquids are both present and is generally defined to overlie the cylindrical portion 32 of the drum 30. The other region is called the beach and is referred to by the letter B. The beach B is generally where the liquids are separated from the solids and is generally defined as overlying the frustoconical portion 31.

As noted above with respect to the difference in rotational speeds of the drum 30 the conveyor the helical blade 44 moves the materials in the pond P toward and up the beach B to the solids outlet 35. The solids tend to be more effected by friction at the internal surface 33 and are therefore easily pushed up the inclined beach B. The liquids are not as effected by the friction and therefore flow between the flights of the blade 44 down the beach B into the pond P. The solids initially have the consistency of mud as they first emerge from the pond P, but the centrifugal forces cause the liquids to flow back down the beach B causing the solids to dry. There will, however, be a residue of liquid left in the solids and held there because of surface tension. The liquids mixed with the particulate solids are separated from the solids in the pond P and form a liquid layer on top of the solids under the effect of the centrifugal force. Thus, the material that overflows the weirs 37, is virtually entirely liquid. However, smaller particles apparently take longer than larger particles to separate under the centrifugal force. Accordingly, clarification can be improved by simply lengthening the residence time of the material as noted above or by providing some mechanism to enlarge the size or average size of the particles.

Figure 3:
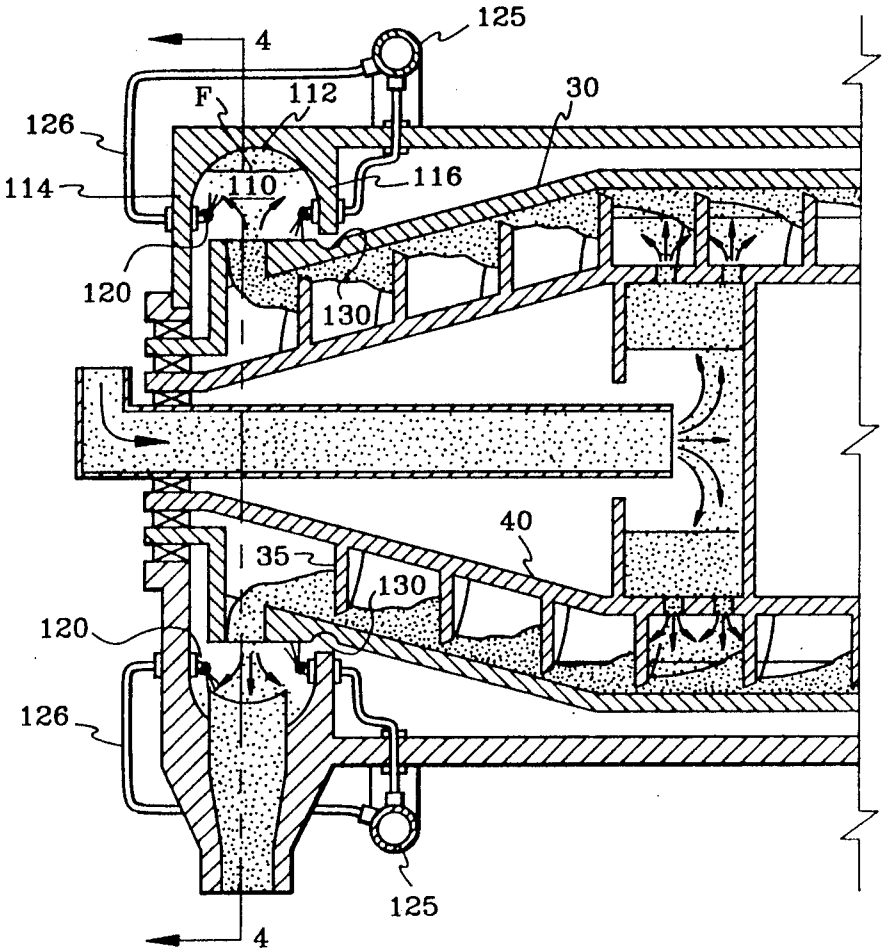
FIG. 3 is an enlarged fragmentary cross sectional view of the preferred embodiment of a decanter centrifuge particularly illustrating the features of the invention.

Since it has been determined that particle destruction is likely to occur at the discharge of the drum in the decanter centrifuge, an improved discharge has been created to reduce particle disintegration. Referring now to FIG. 3, there is illustrated a preferred embodiment of the present invention and is generally indicated by the numeral 100. The decanter centrifuge 100 is similar to the conventional decanter centrifuge 10 in both design and function, however, the improved centrifuge 100 includes an improved particulate receiving chamber generally indicated by the number 110 Due to the similarity in design and function of the new and conventional centrifuges, common elements and features are indicated by the same number and a redundant and unnecessary explanation of the same has been omitted.

Figure 4:
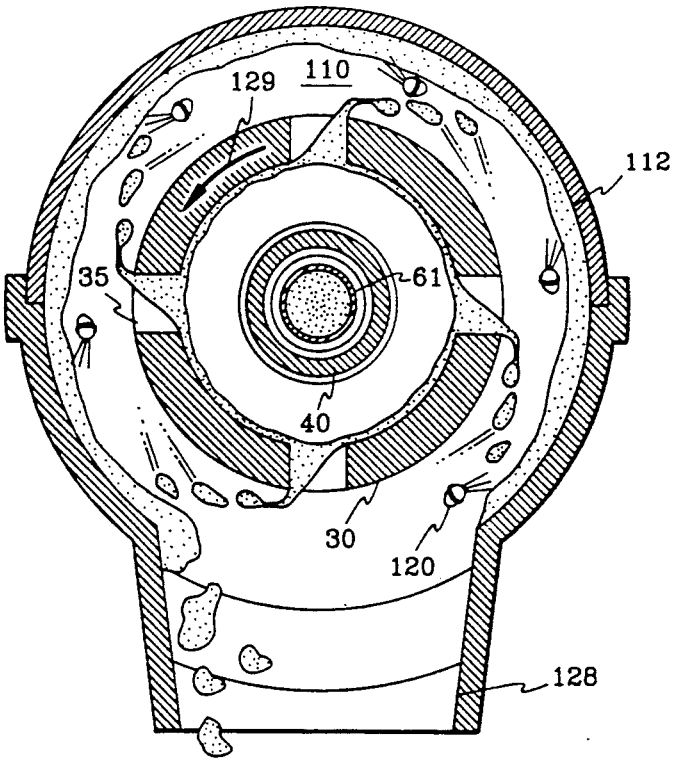
FIG. 4 is a cross sectional view taken along the line 4—4, in FIG. 3.

The improved particulate receiving chamber 110 is fixed at the end of the casing 105 and defines an annular space enclosing the end of the drum 30 so as to receive the solids being discharged from the ports 35. The chamber 110 has an open inner diameter so as to be open to receive the particulate solids and includes a base wall 112 spaced oppositely from the open inner diameter. The base wall 112, as best seen in FIG. 4, is spaced from and extends coaxially about the drum 30. The base wall 112, as best seen in FIG. 3, is preferably rounded in cross section as will be explained later. Extending toward the drum 30 at either side of the base wall 112 is an end wall 114 of the casing 105 and a chamber wall 116.

Figure 2:
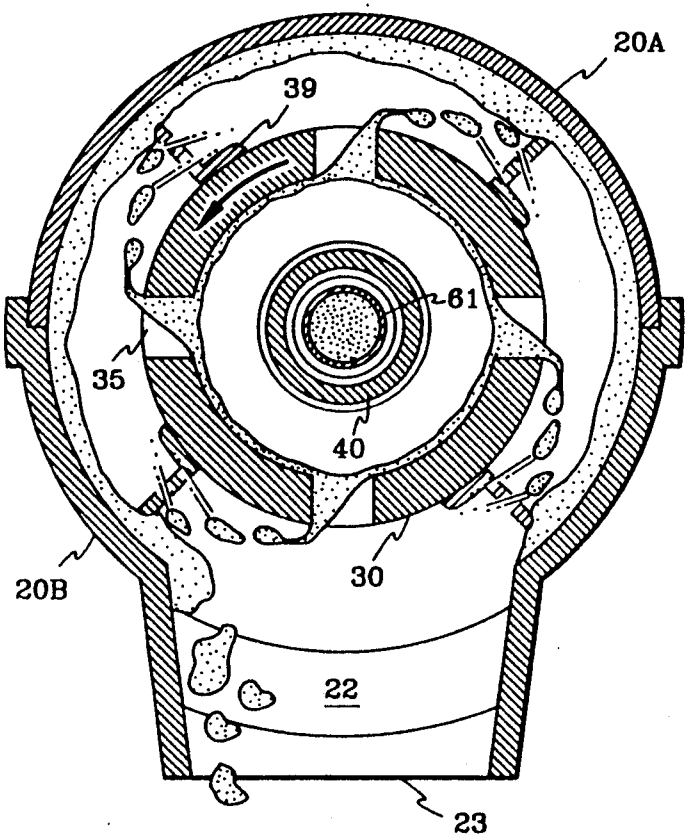
FIG. 2 is a cross sectional view taken along the line 2—2 in FIG. 1.

The chamber 110 further includes a plurality of spray nozzles 120 to spray fluid therein so that the fluid absorbs some of the impact forces of the solids impacting against the walls 112, 114 and 116. It should be noted that other methods may be utilized for providing the fluid to the chamber 10, however, the spray nozzles are preferred. At least some of the nozzles 120 are directed generally toward the base wall 112 to provide a coating or pool F of fluid thereon. The pool F of fluid thereby cushions the impact of the particulate solids. Preferably, all the nozzles 120 are aimed in a direction corresponding to the rotation of the drum 30 such that the liquid in the pool F is moving therearound in the same direction as the tangential motion of the solids exiting the drum 30. This will further provide a means of transporting the solids around inside the casing to the solids exit 128. Other nozzles may be directed generally toward the ports 35 of the drum 30 to coat the particles as they are discharged therefrom. As such the liquids which wet the surface of drum 30 may be flung off into the pool F with a tangential component of velocity which will assist in transporting solids around to the exit 128 In the preferred embodiment, the nozzles directed toward the base wall 112 are positioned at the end wall 114, and the other nozzles which are directed generally toward the ports 35 are mounted at the chamber wall 116. While the majority of particulate solids are expected to impact with greatest force against the base wall 112, it should be understood that the fluid in the chamber 110 should provide a scalar reduction of the impact forces of all collisions therein. The liquid layer also prevents the solids from adhering to the cover 112 and helps transport the solids to the solids exit 128 thus preventing any buildup of solid material on the inside of the particulate receiving chamber 110. Thus, a plough, such as indicated by the number 39 in the prior art FIG. 2 would not be necessary to push the solids to the exit 128. Thus, the collisions between the plough and the solids are completely avoided. The nozzles 120 are provided with fluid from a common header 125 through individual connections 126. The nozzles, however, are preferably individually controlled so that fluid flow rates may be adjusted and balanced throughout the chamber 110.

A preferred feature of the present invention is a groove 130 in the periphery of the drum 30. The groove 130 prevents the solids and fluid, which may splash around the particulate receiving chamber 110, from migrating along the periphery of the drum to other portions of the decanter centrifuge. The chamber wall 116 is further configured to extend into the groove to block as much of the path of flight out of the chamber 110. To further prevent materials in the chamber 110 from escaping into other portions of the chamber, nozzles are positioned along the chamber wall and directed toward the ports 35. The spray from the nozzles would further prevent materials from escaping.

As noted above, the base wall 112 has a rounded cross section as indicated in FIG. 3. This is a preferred feature of the invention for enhancing the flow of the fluid and particulate mixture out of the chamber 110. By rounding the base wall, the fluid is directed into a relatively deeper channel than in a flat wall configuration. The deeper channel concentrates the fluid flow to carry the particulate solids to the outlet 128.

Figure 5:
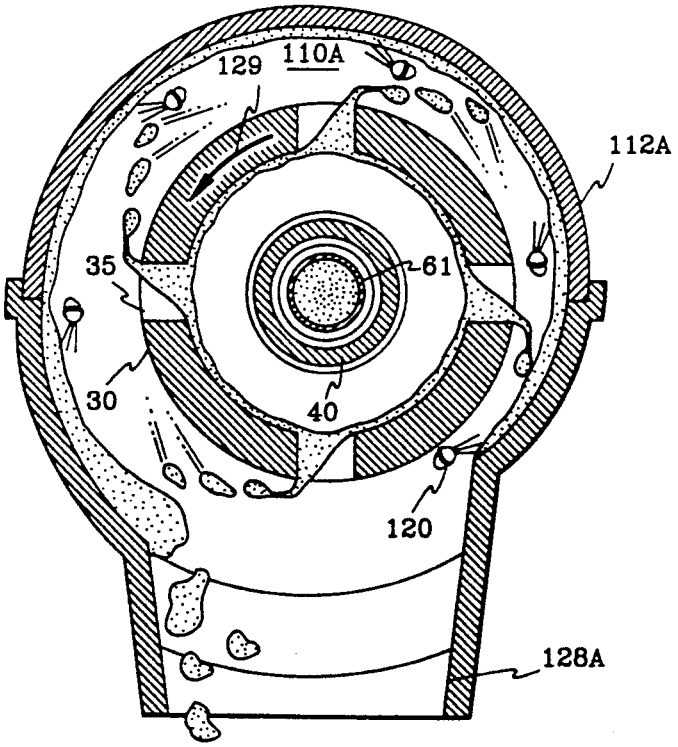
FIG. 5 is a cross sectional view similar to FIG. 4 illustrating an alternative embodiment of the invention.

In an alternative arrangement illustrated in FIG. 5, the particle receiving chamber **110*a* is provided in the shape of a logarithm spiral so as to further utilize the kinetic energy of the particulate solids to move the solids to the solids exit 128*a*. The particular shape of the chamber 110*a* may also be described as an equiangular spiral and is similar to the outlet of centrifugal pumps as known in that art. By this alternative arrangement, less fluid may be used to flush the solids out of the particulate receiving chamber 110**.

A particular advantage of the present invention is obtained when the solids are to be dispersed in another fluid according to the treatment process. The system illustrated in FIG. 6 is similar to the system disclosed in the above referenced patent application with changes to accommodate the decanter centrifuge of the present invention.

Figure 6:
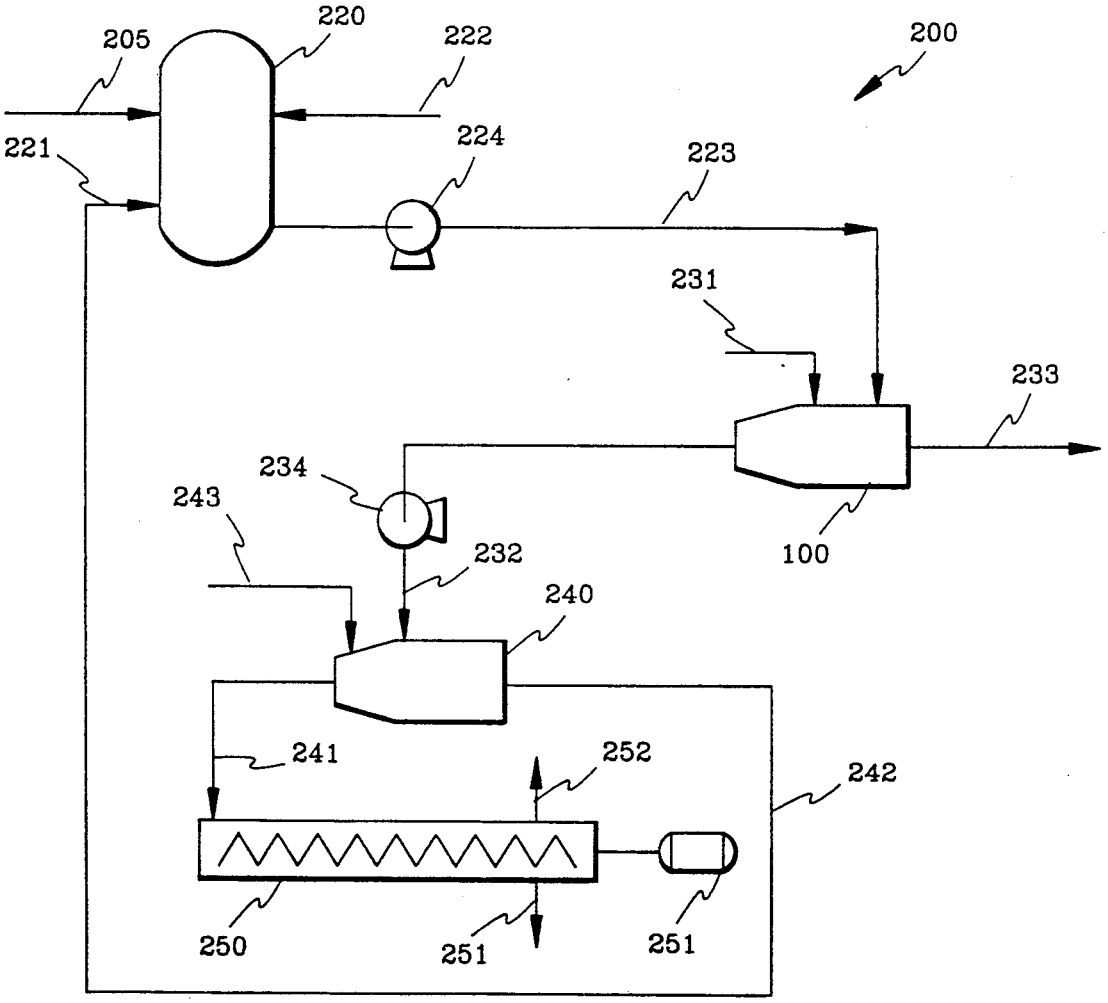
FIG. 6 is schematic view of a system for cleaning particulate solids contaminated with a solvent soluble contaminate incorporating the improved decanter centrifuge of the present invention.

Referring now to FIG. 6, the decanter centrifuge 100 is utilized in a system, generally referred to by the number 200, for cleaning particulate solids. The system 200 is particularly adapted to clean drill cuttings from a well drilling operation which are soaked with oil-based drilling fluid. The drilling fluid is used as a lubricant for the drill bit and as a means for flushing cuttings from the borehole. Once the cuttings are carried up the borehole to the well head, it is desired to separate the drilling fluid therefrom for further use and to dispose of the drill cuttings in an economical and environmentally sound manner. In offshore drilling installations, it is considerably more economical to be able to dispose of the drill cuttings by returning them to the seafloor. However, the cuttings must first be cleaned of the oil-based drilling fluid adhering to the particulate cuttings prior to being discharged into the sea. It should be clearly understood, however, that the system 200 may be fully suitable for cleaning other materials or may be adapted to clean other particulate solids.

The system 200 operates in a continuous manner and comprises an incoming line 205 carrying particulate drill cuttings mixed with oil-based drilling fluid adhering thereon into a slurry tank 220. In the slurry tank 220, the drill cuttings are mixed with a solvent to dissolve the oil-based drilling fluid and form a slurry. The solvent is introduced to the slurry tank 220 via a solvent inlet line 221 so as to thoroughly mix with the drill cuttings and dissolve as much contaminate as possible Solvent make up line 222 provides additional or make up solvent for the slurry tank 220. The slurry is introduced to the decanter centrifuge 100 via a slurry line 223. Since the slurry is pumpable, a pump 224 may be used to pump the slurry into the decanter centrifuge 100. The decanter centrifuge 100 includes the improved particulate receiving chamber 110 as discussed above and illustrated in FIGS. 3 and 4.

The decanter centrifuge 100 separates the particulate drill cuttings from the oily liquid solvent in the drum 30 as discussed above in regard to FIG. 1. A solvent feed line 231 provides relatively contaminant free liquid solvent to the nozzles 120 (FIGS. 3 and 4) for mixing with the particulate solids as they emerge from the ports 35 (FIGS. 3 and 4). The additional solvent dissolves additional contaminant from the particulate solids which is enhanced by the agitation and mixing in the particulate receiving chamber 110.

The mixture of particulate drill cuttings and liquid solvent is withdrawn from the decanter centrifuge 100 via slurry conduit 232 and pump 234 to a second decanter centrifuge 240. As in the operation of the first decanter centrifuge, the second decanter centrifuge 240 centrifugally separates the mixture in the rotating drum 30 and directs the drill cuttings through the ports 35 to the particulate receiving chamber. In the preferred system, the second decanter centrifuge 240 includes an improved particulate receiving chamber (indicated by the number 110 in FIGS. 3 and 4). A solvent feed line 243 provides relatively contaminant free liquid solvent to the nozzles in the particulate receiving chamber in an amount which reduces the impact forces while not saturating the particulates with solvent. Since the particulates are not to be mixed with the solvent for a further centrifugal separation step, the amount of liquid solvent provided to the inlet 243 is less than being provided to the solvent feed line 231. The drill cuttings are thereafter discharged from the decanter centrifuge 240 via solids discharge line 241. The liquid solvent is discharged at the opposite end of the decanter centrifuge 240 via solvent discharge line 242 and recycled back to slurry tank 220.

In a slight variation of this embodiment, a conventional decanter centrifuge similar to the decanter centrifuge 10 (FIG. 1) may be substituted for the decanter centrifuge 240. Since the process does not include further centrifuging steps, the fragmentation or disintegration of the particulates is acceptable. In a further variation, the system 200 may include a plurality of successive decanter centrifuges having the improved particulate receiving chamber 110. This is a quite workable embodiment to obtain a very clean product since the particulate receiving chamber preserves the mean particle size and clarification in the second, third or subsequent centrifuges.

Turning back to FIG. 6, the particulate drill cuttings being discharged from the second decanter centrifuge 240 still have residual solvent moisture therein although they have been separated from the bulk of the solvent. Accordingly, the system 200 further includes a dryer which for purposes of illustration is depicted as heated auger 250. The particulate solids fed to the auger may be introduced entirely at the entry end thereof or a multiple of locations along its length. The auger 250 is heated by any conventional means to provide temperatures which are at least efficient to vaporize the residual solvent present in the solids. Such heating means may include an internally heated auger or an auger with a heated jacket which utilizes circulated heating fluids or perhaps electrical resistance means.

As the solids continuously move through the dryer 250, any residual solvent is volatilized and served to further strip the contaminates which may not have been dissolved and removed during earlier solvent treatment. The volatilized solvent together with stripped contaminants are removed from the dryer through a vapor line 252. The dried cuttings are discharged through a dried particulates line 251 and are ready to be discharged from the system 100.

While this invention has been described in relation to drill cuttings and particulate solids to mixed with and separated from a liquid, it should be apparent to persons having ordinary skill in the art that the principles of this invention may be applied to processes wherein the mixture is comprised of two immiscible fluids such as oil and water wherein one forms fluid particulates which are subject to fragmentation or shearing. Clearly, the separation or clarification of the two immiscible fluids is enhanced by minimizing or reducing the particle disintegration of the fluid particulates or droplets.

In the foregoing drawings and specification, there has been set forth a preferred embodiment of the invention. Although specific terms are employed, they are used in a generic and descriptive sense only and not for purposes of limitation.

We claim:

1. A centrifugal separation device for separating the components of a fluid and particulate mixture, said device comprising:

a particulate receiving surface;

means for at least partially centrifugally separating the components of the mixture and propelling the particulates against said surface; and means for absorbing impact forces as the particulates impact against said surface comprising an impact absorbing fluid interposed between said means for centrifugally separating the components and said surface.

2. The centrifugal separation device according to claim 1 further comprising means for spraying said impact absorbing fluid into close proximity of said surface.

3. The centrifugal separation device according to claim 1 wherein said means for centrifugally separating the mixture comprises a hollow drum mounted for rotation about an axis and having a particulates outlet at one end and a fluid outlet at the other, and wherein said surface defines an annular chamber which encircles said one end of said drum for receiving particulates being discharged from said particulates outlet.

4. A centrifugal separation device for separating the components of a fluid and particulate mixture, said device comprising:

a housing having a separation chamber and a particulate receiving chamber;

means for introducing the mixture into said separation chamber;

means for causing a whirling motion to the mixture within said separation chamber to affect at least partial centrifugal separation of the fluid and particulate components thereof, whereby the particulate components of the mixture are propelled into said particulate receiving chamber and impacting with an impact force against a surface within said particulate receiving chamber; and means for absorbing impact forces as the particulates impact against said surface comprising an impact absorbing fluid interposed between said means for causing a whirling motion and said surface.

5. The centrifugal separation device according to claim 4 further comprising means for spaying said impact absorbing fluid into said particulate receiving chamber.

6. The centrifugal separation device according to claim 4 wherein said means for causing a whirling motion comprises a hollow drum mounted for rotation about an axis and having a particulates outlet at one end and a fluid outlet at the other, and wherein said particulate receiving particulates being discharged from said particulates outlet.

7. A decanter centrifuge for separating particulates from a fluid, said centrifuge comprising:

a housing;

a hollow drum mounted in said housing for rotation about an axis and having a frustoconical peripheral wall portion with a particulates outlet adjacent the small end of the frustoconical portion, a fluid outlet at the opposite end thereof, and an internal surface extending the length of said drum;

a helical conveyor coaxially positioned in said drum for rotation relative to said drum and including a helical blade extending toward and proximately spaced from the internal surface of said hollow drum;

an inlet in said drum for the mixture of fluid and particulates;

means for rotating said drum at a sufficient rotational speed so as to form a layer of particulates along the internal surface of said drum;

means for rotating said conveyor at a rotational speed slightly different than the rotational speed of said drum so that said helical blade moves the particulates toward the particulates outlet;

an annular particulate receiving chamber encircling said particulates outlet at the small end of said drum and having an open inner circumference adjacent said drum and a base wall opposite said open inner circumference for receiving particulates discharged from said drum; and means for absorbing impact forces of particulates being discharged from said drum and impacting against said base wall in said particulate receiving chamber so as to reduce particle disintegration of the particulates wherein said means for absorbing impact forces comprises an impact absorbing fluid interposed between said particulates outlet and said base wall.

8. The decanter centrifuge according to claim 7 further comprising a plurality of spray nozzles circumferentially spaced about said open inner circumference of said particulate receiving chamber for spraying said impact absorbing fluid into said particulate receiving chamber.

9. The decanter centrifuge according to claim 8 wherein said particulate receiving chamber further comprises an exit through which the materials are discharged from said centrifuge and wherein said nozzles are generally tangentially aimed in the direction of rotation of said drum so as to push the particulates around said particulate chamber to said exit.

10. The decanter centrifuge according to claim 8 wherein a portion of said spray nozzles are directed generally toward said base wall and a second portion of said nozzles are directed generally toward said particulates outlet.

11. The decanter centrifuge according to claim 7 wherein said drum includes a circumferential slot on the outer periphery thereof in the proximity of said particulate receiving chamber to prevent centrifugal migration of materials along the periphery of said drum.

12. The decanter centrifuge according to claim 7 wherein said base wall has a rounded cross section.

13. A system for washing particulates with solvent to remove solvent soluble contaminant from the particulates, the system comprising:

first mixing means for mixing contaminated particulates with solvent to dissolve the contaminant from the particulates and form a first mixture;

a first separation chamber;

means for introducing the first mixture to said first separation chamber;

a particulate receiving chamber disposed to receive particulates from said first separation chamber;

means in said first separation chamber for causing a whirling motion to the mixture therein to affect at least partial centrifugal separation of the fluid and particulate components thereof and whereby the particulate components of the mixture are propelled into said particulate receiving chamber and impact with an impact force against a surface therein;

means for absorbing impact forces as the particulates impact against said surface;

second mixing means for mixing particulates separated in said first separation chamber with solvent to dissolve remaining contaminant on the particulates and forming a second mixture;

a second separation chamber;

means for introducing the second mixture to said second separation chamber;

means in said second separation chamber for causing a whirling motion to the mixture therein to affect at least partial centrifugal separation of the fluid and particulate components thereof.

14. The system according to claim 13 wherein said means for absorbing impact forces comprises an impact absorbing fluid interposed between said first separation chamber and said surface within said particulate receiving chamber.

15. The system according to claim 14 further comprising means for spraying said impact absorbing fluid into said particulate receiving chamber.

16. The system according to claim 13 wherein said first and second separation chambers each comprise a rotating drum and said means for causing a whirling motion in each of said separation chambers comprises means for rotating said drums.

17. The system according to claim 13 further comprising a second particulate receiving chamber disposed to receive particulates from said second separation chamber and which further includes means for absorbing impact forces of the particulates impacting against a surface in said particulate receiving chamber.

18. A system for washing particulates with solvent to remove solvent soluble contaminant from the particulates, the system comprising:

first mixing means for mixing contaminated particulates with solvent to dissolve the contaminant from the particulates and form a first mixture;

a first separation chamber;

means for introducing the first mixture to said first separation chamber;

a particulate receiving chamber disposed to receive particulates from said first separation chamber;

means in said first separation chamber for causing a whirling motion to the mixture therein to affect at least partial centrifugal separation of the fluid and particulate components thereof and whereby the particulate components of the mixture are propelled into said particulate receiving chamber and impact with an impact force against a surface within said first particulate receiving chamber;

means for providing solvent into said first particulate receiving chamber to absorb impact forces as the particulates impact against said surface and to mix with the particulates and to dissolve remaining contaminant on the particulates and forming a second mixture;

a second separation chamber;

means for introducing the second mixture to said second separation chamber;

means in said second separation chamber for causing a whirling motion to the mixture therein to at least partially centrifugal separate the fluid and particulate components thereof.

19. The system according to claim 18 wherein said means for providing solvent comprises means for spraying said solvent into said particulate receiving chamber.

20. The system according to claim 18 wherein said first and second separation chambers each comprise a rotating drum and said means for causing a whirling motion in each of said separation chambers comprises means for rotating said drums.

21. The system according to claim 18 further comprising a second particulate receiving chamber disposed to receive particulates from said second separation chamber and which further includes means for absorbing impact forces of the particulates impacting against a surface in said particulate receiving chamber.

22. A method of reducing particle disintegration in a centrifugal separation device for separating the components of a fluid and particulate mixture and being of the type that includes a separation chamber and a particulate receiving surface for receiving particulates from the separation chamber, the method comprising the steps of:

whirling the mixture in the separation chamber to at least partially centrifugally separate the components and thereby propel the particulates against the particulate receiving surface with an impact force; and absorbing the impact forces of the particulates impacting against the particulate receiving surface to reduce particle disintegration of the particulates by providing an impact absorbing fluid between the separation chamber and the particulate receiving surface whereby the impact absorbing fluid absorbs the impact forces and reduces particle disintegration of the particulates.

23. The method according to claim 22 wherein the step of providing an impact absorbing fluid between the separation chamber and particulate receiving surface comprises spraying the fluid into close proximity of the particulate receiving surface.

24. The method according to claim 23 wherein the step of providing an impact absorbing fluid between the separation chamber and the particulate receiving surface comprises spraying the fluid onto the particulate receiving surface.

25. A method for washing particulates with solvent to remove solvent soluble contaminant from the particulates, the method comprising the steps of:

mixing contaminated particulates with a solvent to dissolve the contaminant from the particulates;

introducing the mixture of particulates and solvent to a first separation chamber;

whirling the mixture in the first separation chamber to at least partially centrifugally separate the components and thereby propel the particulates from the separation chamber against a surface within the particulate receiving chamber with an impact force;

absorbing impact forces of the particulates impacting against the surface so as to reduce particle disintegration of the particulates;

mixing the particulates separated from the solvent in the first separation chamber with solvent to dissolve remaining contaminant on the particulates;

introducing the mixture of particulates and solvent to a second separation chamber; and whirling the mixture in the second separation chamber to at least partially centrifugally separate the components thereof.

26. The method according to claim 25 wherein the step of absorbing impact forces comprises providing an impact absorbing fluid between the first separation chamber and the particulate receiving chamber whereby the fluid absorbs the impact forces and reduces particle disintegration.

27. The method according to claim 26 wherein the step of providing an impact absorbing fluid between the first separation chamber and the particulate receiving chamber comprises spraying the impact absorbing fluid into the particulate receiving chamber from a plurality of locations.

28. The method according to claim 25 wherein said step of whirling the mixture in the second separation chamber causes the particulates to be propelled into a second particulate receiving chamber, and wherein the method further comprises the step of absorbing impact forces of the particulates impacting against the surfaces in the second particulate receiving chamber.

29. A method for washing particulates with solvent to remove solvent soluble contaminant from the particulates, the method comprising the steps of:

mixing contaminated particulates with solvent to dissolve the contaminant from the particulates and form a first mixture;

introducing the first mixture to a first separation chamber;

causing a whirling motion of the mixture in the first separation chamber to affect at least partial centrifugal separation of the fluid and particulate components thereof and whereby the particulate components of the mixture are propelled into a particulate receiving chamber and impact with an impact force against a surface therein;

providing solvent into the particulate receiving chamber to absorb impact forces as the particulates impact against the surface and mix with the particulates to dissolve remaining contaminant on the particulates thus forming a second mixture;

introducing the second mixture to said second separation chamber; and causing a whirling motion of the mixture in the second separation chamber to at least partially centrifugal separate the fluid and particulate components thereof.

30. The method according to claim 29 wherein said step of providing solvent comprises spraying solvent into the particulate receiving chamber from a plurality of locations.

31. The method according to claim 29 wherein said step of whirling the mixture in the second separation chamber causes the particulates to be propelled into a second particulate receiving chamber, and wherein the method further comprises the step of providing solvent into the particulate receiving chamber to absorb impact forces as the particulates impact against surfaces in the second particulate receiving chamber.

* * * * *

UNITED STATES PATENT AND TRADEMARK OFFICE

CERTIFICATE OF CORRECTION

PATENT NO. : 5,151,079

DATED : September 29, 1992

INVENTOR(S) : David A. Flanigan and John D. Boadway

It is certified that error appears in the above-identified patent and that said Letters Patent is hereby corrected as shown below:

Column 4, line 10, "of the drum 30 and the casing with the baffle 38 retain-" should read -- of the drum 30 and the casing 20 with the baffle 38 retain- --.

Column 4, line 61, "rotational speeds of the drum 30 the conveyor the heli-", should read -- rotational speeds of the drum 30 the conveyor 40, the heli- --.

Column 5, line 27, "generally indicated by the number 110 Due to the simi-" should read -- generally indicated by the number 110. Due to the simi- --.

Column 5, line 67, "assist in transporting solids around to the exit 128 In the" should read -- assist in transporting solids around to the exit 128. In the --.

Column 7, line 19, "cuttings and dissolve as much contaminate as possible" should read -- cuttings and dissolve as much contaminate as possible. --.

Column 9, line 24, "spaying" should read -- spraying --.

Column 9, line 33, "late receiving particulates being discharged from said" should read -- late receiving chamber encircles said one end of said drum for receiving particulates being discharged from said --.

Signed and Sealed this

Twenty-sixth Day of October, 1993

*Attest:*

Bruce Lehman

BRUCE LEHMAN

*Attesting Officer*

*Commissioner of Patents and Trademarks*